United States Patent [19]

Yates

[11] Patent Number: 4,752,975

[45] Date of Patent: Jun. 28, 1988

[54] SHOWER HEAD ASSEMBLY HAVING A SECONDARY SHOWER HEAD

[76] Inventor: Richard L. Yates, 2126 Wilmington Dr., Walnut Creek, Calif. 94596

[21] Appl. No.: 53,106

[22] Filed: May 21, 1987

[51] Int. Cl.[4] ..... A47K 3/22

[52] U.S. Cl. ..... 4/601; 4/605; 4/615; 239/207; 239/443; 239/562

[58] Field of Search ..... 4/601, 597, 596, 603, 4/605, 615; 239/208, 207, 267, 266, 282–283, 447, 443, 562, 587

[56] References Cited

U.S. PATENT DOCUMENTS

| | | | |
|---|---|---|---|
| 1,054,922 | 3/1913 | Kenney | 4/601 |
| 2,867,230 | 1/1959 | Bletcher et al. | 239/443 X |
| 3,121,235 | 2/1964 | Gellmann | 4/601 X |
| 3,471,872 | 10/1969 | Symmons | 4/601 X |
| 3,822,826 | 7/1974 | Wilson | 4/601 |
| 3,913,839 | 10/1975 | Wilson | 4/601 X |
| 3,971,074 | 7/1976 | Yxfeldt | 4/601 X |
| 4,203,551 | 5/1980 | Levine | 239/443 X |
| 4,282,612 | 8/1981 | King | 4/601 |

*Primary Examiner*—Henry K. Artis
*Attorney, Agent, or Firm*—Donald L. Beeson

[57] ABSTRACT

A shower head assembly is comprised of a diverter valve for diverting the water supply to one of two shower heads. One of the shower heads is generally laterally and adjustably displaced from the other of said shower heads by means of a swivable extension arm and the entire assembly is easily installable on the existing overhead water supply line of a shower stall or bath enclosure.

9 Claims, 1 Drawing Sheet

SHOWER HEAD ASSEMBLY HAVING A SECONDARY SHOWER HEAD

BACKGROUND OF THE INVENTION

The present invention generally relates to shower head attachments and particularly to an easily installed, dual shower head attachment that provides for convenient positioning of a secondary shower head within a shower stall or bathtub enclosure.

Shower head assemblies incorporating two or more shower heads have previously been devised for the purpose of projecting separate streams of water on a bather standing in a tub or shower enclosure. One such device is disclosed in U.S. Pat. No. 3,913,839 to Yxfeldt, wherein two shower heads are fixed to a rigid tubular support spanning the shower stall. Another design, disclosed in U.S. Pat. No. 3,971,074 to Wilson, includes multiple, fixed shower heads positioned at different points along a C-shaped water line which lies in a generally horizontal plane and which is connected to a relatively complicated vertical slide member used to vertically adjust the entire shower head carrying water line. The foregoing prior designs, however, have the disadvantage of not being easily adjustable and being relatively complex and difficult to install.

The present invention provides a shower head assembly which, upon removing the existing conventional shower head, can easily be screwed as a unit onto the end of the shower's water supply line. The invention provides, in addition to a primary shower head, a displaced secondary shower head which can be easily and manually positioned from within the shower; it also provides a secondary shower head which can be repositioned through a full range of repositioning movements for redirecting a secondary stream of water onto the bather from one side of the shower from most any overhead direction. Such a shower head assembly is provided with a relatively simple structure, and is provided so that water flow can be manually diverted to either the primary shower head or the secondary positionable shower head, or both shower heads, as desired. The invention will enable a bather to shower from either or both sides of the shower, and will permit the shower to more readily accommodate two bathers.

SUMMARY OF THE INVENTION

The shower head assembly of the invention includes first and second shower heads fluidly connected to a diverter valve which controls water flow to the shower heads from the shower's overhead water supply line. The second shower head of the assembly is connected to the diverter valve by means of a rigid extension arm which operatively holds the second shower head in generally laterally displaced relation to the first shower head. From these laterally separated shower heads a stream of water can be directed downwardly onto the bather from different overhead positions, and generally from opposite sides of a shower stall.

In the preferred embodiment of the invention the base end of the rigid extension arm is connected to the diverter valve so as to permit angular movement of the extension arm to in turn permit manual adjustment of the overhead position of the second shower head; preferably this base end is swivably connected to permit freedom of movement of the extension arm within an infinite number of planes. Also, the second shower head itself is preferably swivably connected to the distal end of the extension arm to permit an additional degree of adjustment.

It will therefore be seen that a primary object of the present invention is to provide a relatively simple, low cost, and easily installed dual shower head assembly which provides for easy adjustment of two shower heads relative to each other to provide streams of water from different desired overhead positions within a shower stall or bath enclosure.

DETAILED DESCRIPTION OF THE ILLUSTRATED EMBODIMENT

Figure 1:
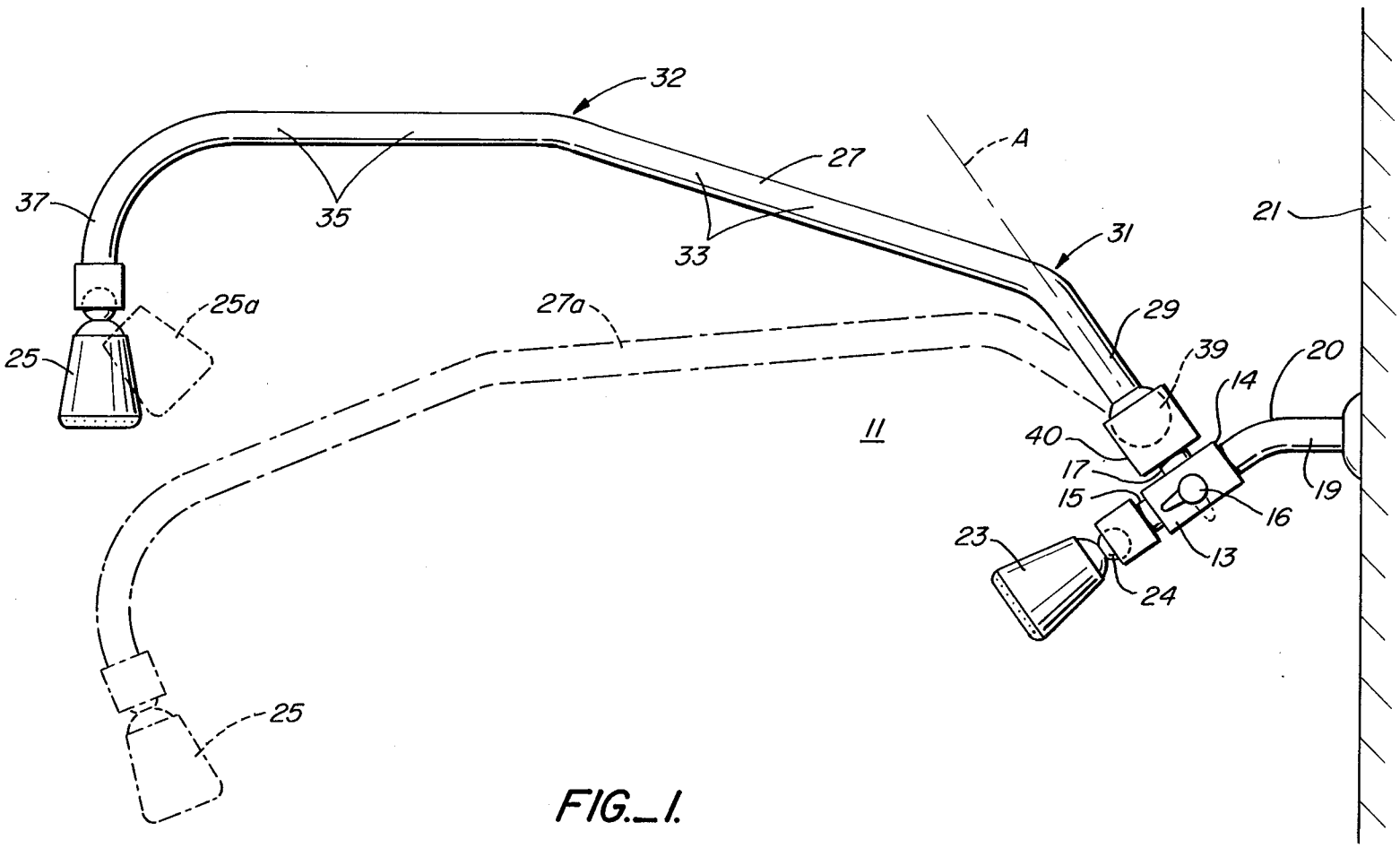
FIG. 1 is a side elevational view of a shower head assembly according to the invention.

Referring now to the drawing, a shower head assembly, generally depicted by the numeral 11, includes a fluid inlet 14 and diverter valve means in the form of a diverter valve 13 havig a first fluid outlet 15 and a second right angle fluid outlet 17. The diverter valve acts to divert water flow from the overhead water supply line 19 extending through the shower wall 21 to the separate first and second shower heads 23, 25. Specifically, the first shower head 23 is fuidly connected to the first fluid outlet 15 of the diverter valve 13, preferably by means of a relatively short swivel connector 24 which permits a swivel adjustment of this shower head; a rigid extension arm 27 having a base end 29 and distal end 37 fluidly connects the second shower head 25 to the second fluid outlet of the diverter valve so as to operatively hold this shower head in a position which, as shown in FIG. 1, is generally laterally displaced from the first shower head. It can readily be appreciated that the lateral displacement of the two shower heads will provide two potential streams of water from two different generally overhead positions within a shower stall or bath enclosure. As hereinafter described, a bather will be able to selectively operate either or both of the first or second shower heads by means of the diverter valve.

The extension arm 27 is preferably fabricated from a single length of tubing, for example, stainless steel tubing or nickle or chrome plated steel tubing, suitably bent to dispose the second shower head in a generally laterally displaced, downwardly directed position. In FIG. 1 the water supply line 19 is shown as having a downward bend 20 of roughly 30 degrees from horizontal. The diverter valve 13 connected to the end of the water line is also seen to have the same downward angle and the second right angle fluid outlet of this valve accordingly is seen to project upwardly at a complementary angle of roughly 60 degrees from horizontal. To provide a suitable extension from the second fluid outlet so positioned, the extension arm is bent twice at 31 and 32 to form two long sections 33, 35 with the last, most elevated section 35 lying in a generally horizontal plain when the extension arm is adjusted to its center position as shown in the solid line representation thereof in FIG. 1. At its distal end 37 the extension arm curves downwardly through approximately a 90 degree angle to provide for the downwardly directed second shower head.

It should be understood that the extension arm can be provided with shapes and configurations other than above described, so long as such other shapes and configurations produce the desired lateral displacement of the second shower head. Generally, an upwardly overall curvature to the extension arm is needed to provide standing room underneath the shower head assembly. However, it is also advantageous to keep the curvature of the arm relatively shallow to permit easy installation as hereinafter described and to minimize the weight of the arm.

In the preferred illustrated embodiment, the second shower head is provided with two degrees of adjustment. First, the base end 29 of the extension arm is connected to the second fluid outlet 17 of the diverter valve 13 so as to permit angular displacement of the extension arm about its base end. In the illustrated embodiment, a swivel connection 39 is provided wherein the extension arm can be angularly displaced in an infinite number of planes about the swivel axis denoted in FIG. 1 by the letter "A". FIG. 1 particularly illustrates a downward, vertical plane angular adjustment of the extension arm to a lowered position indicated by the phantom lines 27*a;* adjustments with a horizontal plane component would additionally displace the arm and shower head toward or away from the plane of the drawing.

The second shower head 25 is also preferably provided with a swivel connection at the distal end 37 of the extension arm to provide a second degree of adjustment to the stream of water from this shower head. The swivel adjustment of the second shower head is illustrated by the phantom line representation 25*a* showing the second shower head turned inwardly. Thus, in addition to the extension arm swivel adjustment, both shower heads are also swivably adjustable.

It is contemplated that the shower head assembly of the invention will be sold and installed as an entire unit on a retrofit basis. Such an installation is made by simply placing the internally threaded fluid inlet 14 of the diverter valve over the threaded male end of the fluid supply line 19 and rotating the assembly about the diverter valve. To do this, the extension arm should be swiveled down to a lowered position 27*a* to prevent the arm from striking the sidewall of the shower stall as it is rotated.

As an alternative to installing the assembly as a unit the base of the extension arm 29 can be uncoupled from the diverter valve. In this regard it is noted that the swival connection 39 at the base end 29 of the extension arm is a ball joint connector having an internally threaded collar 40; it is further noted that the second fluid outlet 17 of the diverter valve has a threaded male end coupler (not shown) for threadably receiving the threaded collar of the ball joint connector. By using a suitable ball joint connector for this swivel connection the tension in the extension arm can easily be adjusted by tightening or loosening the threaded collar 40 on the diverter valve coupler. Thus, if the extension arm tends to sag, the ball joint can simply be tightened down. If, on the other hand, if the arm is too stiff and excessive force is required to adjust it, then the collar can be loosened somewhat. A one and one-half inch ball is recommended to provide sufficient holding force against sagging of the arm.

To operate an installed shower head assembly in accordance with the invention, a person using the shower, need only turn the manual valve handle 16 on the side of the diverter valve to a position that turns on either the first shower head or the second head according to his or her desires. It should be readily appreciated that the diverter valve could be a two-way diverter valve for turning on one shower head or the other, but not both; a three-way diverter valve for turning on either one shower head or the other, or both shower heads simultaneously; or a four-way diverter valve which in addition to the capabilities of the three-way diverter valve also permits a fourth position for turning the shower heads completely off. In any event, the user will have the flexibility of providing a downwardly directed stream of water from two different laterally displaced positions. Also, by simply reaching up and pulling on the extension arm, and/or swiveling either or both of the shower heads themselves, the user can further adjust the relative overhead positions and flow directions of these two streams of water.

Therefore, the present invention as described is an easily installed, relatively simple to use, and low cost overhead shower assembly which provides an existing shower with a greater range of shower flow configurations. Although, the invention has been described in the foregoing specification in considerable detail, it is not intended that the invention be limited to such detail, except as is necessitated by the following claims.

What I claim is:

1. A shower head assembly having a secondary shower head comprising:

a fluid inlet, diverter valve means for receiving fluid through said fluid inlet, said diverter valve means having first and second fluid outlets, a first shower head fluidly connected to the first fluid outlet of said diverter valve means, a second shower head, and a rigid extension arm fluidly connecting said second shower head to the second fluid outlet of said diverter valve means and for operatively holding said second shower head in a position which is generally laterally displaced from said first shower head, said diverter valve means being adapted to controllably direct fluid flow from said fluid inlet to said first and second shower heads.

2. The shower head assembly of claim 1 wherein the extension arm for said second shower head has a base end and a distal end, and wherein the base end thereof is connected to the second fluid outlet of said diverter valve means so as to permit angular displacement of said extension arm for adjustably positioning said second shower head.

3. The shower head assembly of claim 2 wherein the base end of said extension arm is swivably connected to the second fluid outlet of said diverter valve means to provide freedom of movement of said second shower head about a swivel axis at said extension arm base end.

4. The shower head assembly of claim 3 wherein said second shower head is swivably connected to the distal end of said extension arm.

5. A shower head assembly having a secondary shower head comprising:

a fluid inlet adapted to be installed on the end of a fluid supply line, a diverter valve means for receiving fluid through said fluid inlet, said diverter valve means having first and second fluid outlets and a hand accessible manual switch means for controllably directing fluid flow from said fluid inlet to said first and second fluid outlets, a first shower head connected to the first fluid outlet of said diverter valve means through a relatively short fluid connection, a second shower head, and a rigid extension arm fluidly connecting said second shower head to the second fluid outlet of said diverter valve means and for operatively holding said second shower head in a position which is generally laterally displaced from said first shower head, said extension arm having a base end swivably connected to the second fluid outlet of said diverter valve means and a distal end, said second shower head being swivably connected to said extension arm distal end.

6. The shower head assembly of claim 5 wherein said diverter valve means is in a two way valve for directing fluid flow to one or other of said first and second shower heads.

7. The shower head assembly of claim 5 wherein said diverter valve means is a three-way valve for directing fluid flow to one or the other or to both of said first and second shower heads.

8. The shower head assembly of claim 5 wherein said diverter valve means includes a manual switch position for completely shutting off both of said first and second shower heads.

9. The shower head assembly of claim 5 wherein said first shower head is swivably connected to the first fluid outlet of said diverter valve.

* * * * *